United States Patent [19]

Borman

[11] Patent Number: 4,527,958

[45] Date of Patent: Jul. 9, 1985

[54] CONTROL VALVING FOR A VARIABLE CAPACITY PUMP

[75] Inventor: August H. Borman, Farmington, Mich.

[73] Assignee: General Motors Corporation, Detroit, Mich.

[21] Appl. No.: 613,717

[22] Filed: May 24, 1984

[51] Int. Cl.[3] ..... F04B 49/08

[52] U.S. Cl. ..... 417/213; 417/218

[58] Field of Search ..... 417/213, 218, 219, 220, 417/221, 222, 281, 302, 303, 304

[56] References Cited

U.S. PATENT DOCUMENTS 2,799,995 7/1957 Herman ..... 417/220 X
3,588,285 6/1971 Moon ..... 417/281 X
4,342,545 8/1982 Schuster ..... 418/30 X
4,456,434 6/1984 Ellbiary ..... 417/218

*Primary Examiner*—Richard E. Gluck
*Attorney, Agent, or Firm*—Donald F. Scherer

[57] ABSTRACT

A variable capacity pump delivers fluid at full displacement until both the main high pressure system and the lube system are satisfied. The main system pressure is regulated by a valve connected to the pump discharge while the lube pressure is regulated by a valve disposed in fluid communication with the overflow of the main system valve. The lube system valve establishes fluid pressure for the lube system and directs excess fluid to the displacement control for the pump whereby pump displacement is decreased when both systems are satisfied.

2 Claims, 1 Drawing Figure

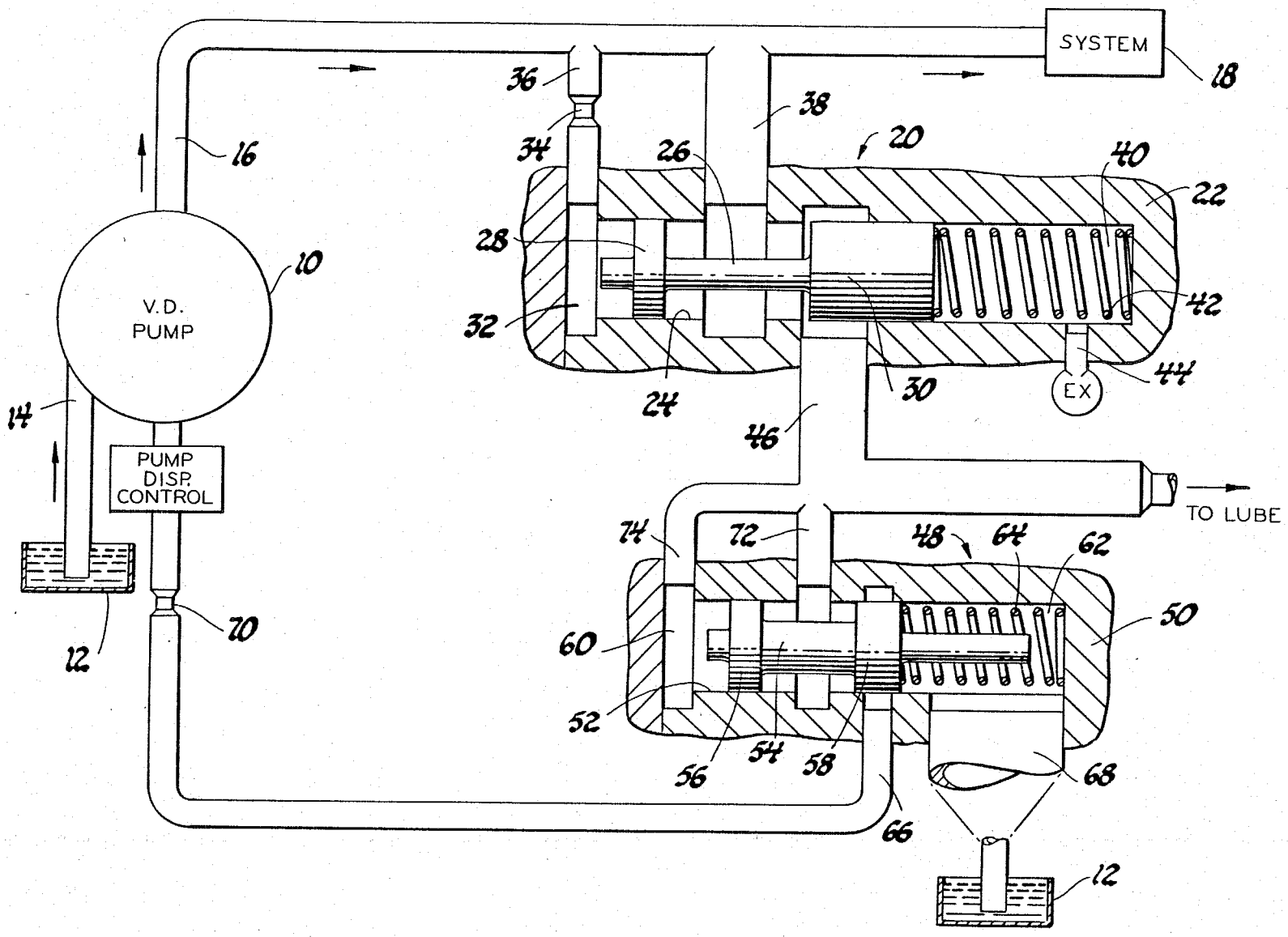
SYSTEM
TO LUBE
EX
V.D. PUMP
PUMP DISP. CONTROL

CONTROL VALVING FOR A VARIABLE CAPACITY PUMP

This invention relates to hydraulic control valves and more particularly to hydraulic control valving for a variable displacement pump.

Prior art systems utilizing variable capacity pumps provide for fluid lubrication either from leakage in the high pressure system or from the return fluid flow of one or more of the devices in the high pressure system. Rapid changes, requiring increased fluid flow to the high pressure system, must be accommodated by increases in pump displacement. Therefore, in these prior art systems, the instantaneous increase in fluid flow to the high pressure system is limited by the response time of the pump for a displacement change.

The present invention feeds the lube system with overflow from the high pressure regulator. Thus, the pump, at this point, is delivering more fluid than required by the high pressure system. The fluid flow in excess of lube requirements, is bypassed by a lube regulator to cause a decrease in pumping displacement. If an increase in the flow requirements of the high pressure system should occur, the high pressure regulator valve will reduce or eliminate the lube flow. The previous lube flow will be diverted instantaneously to the high pressure system. Thus, an immediate increase in fluid flow to the high pressure system is obtained prior to a change in the pump capacity. The reduction of lube flow will signal for an increase in pump capacity. However, the pump response time will not affect the instantaneous fluid flow rate to the high pressure system since the instantaneous flow change to the system is accommodated by a reduction of lube flow rather than an increase in pump capacity.

It is an object of this invention to provide an improved control valve arrangement for a variable capacity pump wherein the instantaneous change of fluid flow to the high pressure system is not affected by pump capacity change response time.

It is another object of this invention to provide an improved control valving arrangement for a variable capacity pump wherein a high pressure regulator valve distributes fluid to a high pressure system and directs excess flow to a lube system and wherein a lube regulator valve establishes lube pressure and directs fluid to reduce pump capacity when the lube flow is satisfied so that instantaneous flow increase demands of the high pressure system cause the high pressure regulator to establish an instantaneous increase in flow to the high pressure system and a reduction in flow to the lube system so that the high pressure system is not affected by pump displacement change response time.

These and other objects and advantages of the present invention will be more apparent from the following description and drawing which is a diagrammatic representation of a hydraulic system with a variable displacement pump and control valving.

The hydraulic system shown in FIG. 1 includes a variable displacement pump 10 which draws fluid from a reservoir 12 through an inlet passage 14 and delivers fluid to a main passage 16 which is in fluid communication with a high pressure hydraulic system 18 and a high pressure regulator valve 20. The variable displacement pump 10 may be constructed in accordance with the variable displacement pump described in U.S. Pat. No. 4,342,545 issued to Schuster Aug. 3, 1982 and assigned to the assignee of the present invention. The variable displacement pump may also be constructed in accordance with many of the variable displacement pumps which are presently available.

The high pressure system 18 can include such devices as variable pulley drives, control valves, fluid couplings or torque converters. As a general practice, the pressure regulator valve 20 can be incorporated within the same valve body as the valving of system 18 or within the housing of pump 10. The construction of either of such arrangements is well-known.

The regulator valve 20 includes a housing portion 22 in which is formed a bore 24. The bore 24 has slidably disposed therein a spool valve 26 having a pair of lands 28 and 30 which are in sliding sealing contact with the bore 24. The land 28 cooperates with the left end of bore 24 to form a control chamber 32 which is in fluid communication through a restriction 34 and passage 36 with the main passage 16. The main passage 16 is also in fluid communication through a passage 38 with the space between lands 28 and 30.

The valve land 30 cooperates with the bore 24 to form a chamber 40 in which is disposed a spring 42. The spring 42 urges the valve spool 26 leftward toward chamber 32. The chamber 40, as shown, is connected to exhaust through a passage 40 such that pressure buildup will not occur within the chamber 40. As is well-known, the chamber 40 can be in fluid communication with various control devices such as an engine controlled throttle valve to provide a variable pressure regulator.

The bore 24 is in fluid communication with a lube feed passage 46. The lube feed passage 46 is controlled in opening and closing relation to passage 38 by land 30 of valve spool 26. When the fluid pressure in chamber 32 from pump 10 is sufficient to overcome the force of spring 42, the valve 26 will move rightward to allow land 30 to direct fluid from passage 38 to passage 46. The pressure in chamber 32 is reflective of the pressure requirement of system 18. Therefore, the valve spool 26 will not bypass fluid flow until the pressure requirement and flow requirement of system 18 is satisfied. Assuming the flow requirement of system 18 is satisfied, fluid flow will be directed to the lube feed passage 46.

The lube feed passage 46 is operable to deliver fluid for lubrication to various components such as gears, variable ratio pulley drives or bearings found within a power transmission. The lube feed passage 46 is also connected to a lube pressure regulator valve, generally designated 48. The lube pressure regulator valve 48 includes a housing portion 50 which may be integral with the housing portion 22. A bore 52 is formed in the housing portion 50 and a valve spool 54 is slidably disposed therein on valve lands 56 and 58. The valve land 56 cooperates with the valve bore 52 to form a lube pressure control chamber 60 and the land 58 cooperates with bore 52 to form a chamber 62 in which is disposed a spring 64.

The valve bore 52 is also in fluid communication with a pump displacement control passage 66 and an exhaust passage 68. The exhaust passage 68 is connected to the reservoir 12 and the pump displacement control passage 66 is connected through an orifice or restriction 70 with the displacement control structure of the variable displacement pump 10.

The space intermediate lands 56 and 58 is in fluid communication with the lube feed passage 46 through a passage 72 and the control chamber 60 is also in fluid communication with the feed passage 46 through a passage 74.

Fluid pressure in control chamber 60 is effective to urge the valve spool rightward against the force in spring 64. When the fluid pressure in control chamber 60 is sufficient to overcome the force in spring 64, the valve spool 54 will move rightward to pass excess flow from the lube feed passage 46 to the pump displacement control passage 66. Fluid flow in the pump displacement control passage 66 will cause a reduction in the displacement of pump 10 which will result in a reduction in fluid flow to the feed passage 46 through valve 20. The pump displacement will continue to reduce as will fluid flow to feed passage 46 until the pressure in the lube feed passage 46 is sufficient to maintain the valve spool 54 in the position shown whereby the pressure in displacement control passage 66 will neither increase nor decrease.

If the pressure in lube feed passage 46 should decrease, the valve spool 54 will move leftward under the influence of spring 64 to establish fluid communication between the displacement control passage 66 and the exhaust passage 68. This fluid communication will decrease the fluid pressure in the displacement control mechanism of pump 10 thereby permitting an increase in the pump displacement.

If a reduction in pressure should occur in system 18, the spool valve 26 will move leftward thereby reducing or eliminating the fluid flow to lube feed passage 46. Thus, the fluid flow to the lube feed passage will be instantaneously diverted to satisfy the increased flow requirement of system 18. If, for example, the lube flow requirement was one liter per minute, the fluid flow to the high pressure system 18 could be instantaneously increased by one liter per minute without a change in the displacement of pump 10.

As described above, however, a reduction in fluid flow in lube feed passage 46 will result in leftward movement of valve spool 54 and an exhausting of the displacement control mechanism of pump 10. This, of course, will signal an increase in pump displacement. However, it is well-known that mechanical systems requre some time to respond to these changes. Under prior art systems, this response time would have been met by a significant reduction in the pressure of system 18. With the present invention, howver, the pump response time is insignificant since the fluid flow to system 18 is increased through a reduction of lube flow on an instantaneous basis and not through pump displacement change. If the fluid flow requirement of system 18 should continue to increase, such increase would be accommodated by the then changing displacement of pump 10. The redirection of lube flow therefore accommodates pump response time to maintain the pressure and flow of system 18 at the desired level independently of pump response.

The devices being lubricated can withstand short time periods while pressurized lubrication is interrupted. Since the transition period required for pump displacement change is very short relative to lube flow requirements, the components being lubricated will not be affected by the interruptions of lube flow for the short period of time.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. An improvement in control valves for a high pressure system and a lube pressure system including a variable capacity pump having a displacement control mechanism which is responsive to fluid pressure in excess oil returned from a regulator valve such that an increase in fluid pressure at the control mechanism is accompanied by a decrease in pump displacement wherein the improvement comprises: a first pressure regulator valve means connected directly with the outlet of said variable capacity pump and being operative to establish a pressure level in said high pressure system and also being operable to bypass excess fluid flow; and a second regulator valve means for establishing a pressure level for said lube pressure system in said excess fluid flow from said first pressure regulator valve means and bypassing the fluid unused by the lube pressure system to the displacement control mechanism of said variable capacity pump to thereby decrease the pump capacity when the high pressure system and lube pressure system have been satisfied.

2. An improvement in control valves for a high pressure system and a lube pressure system including a variable capacity pump having a displacement control mechanism which is responsive to fluid pressure in excess oil returned from a regulator valve such that an increase in fluid pressure at the control mechanism is accompanied by a decrease in pump displacement wherein the improvement comprises: a first pressure regulator valve means connected directly with the outlet of said variable capacity pump by being operative to establish a pressure level in said high pressure system and also being operable to bypass excess fluid flow; and a secondary pressure regulator valve means for establishing a lube pressure level for said lube pressure system in said excess flow from said first pressure regulator valve means and bypassing the fluid unused by the lube pressure system to the displacement control mechanism of said variable capacity pump to increase the pressure therein and thereby decrease the pump capacity when the high pressure system and the lube pressure system have been satisfied, and said first regulator valve means being operable upon increased flow demand by said high pressure system to instantaneously reduce flow to said secondary pressure regulator valve means and to simultaneously increase fluid flow to the high pressure system prior to a displacement change in said pump.

* * * * *